United States Patent [19]

Boyd et al.

[11] Patent Number: 5,011,005

[45] Date of Patent: Apr. 30, 1991

[54] PROTECTIVE COIN HOLDER

[75] Inventors: Bruce D. Boyd, Sidney; Robert J. Geoghegan, Columbus; Barbara A. Metz, Baltimore; Karen L. Rosen; Richard D. Rosen, both of Hilliard, all of Ohio; Alex Bally, Pittsburgh, Pa.; Ronald J. Sears, Worthington, Ohio

[73] Assignee: Amos Press, Inc., Sidney, Ohio

[21] Appl. No.: 383,368

[22] Filed: Jul. 20, 1989

[51] Int. Cl.[5] ..... A45G 1/00

[52] U.S. Cl. ..... 206/0.81; 206/0.82; 206/807

[58] Field of Search ..... 206/0.8, 0.81, 0.82, 206/0.83, 0.84, 807

[56] References Cited

U.S. PATENT DOCUMENTS

| | | | |
|---|---|---|---|
| 3,139,977 | 7/1964 | Burdick | 206/0.83 |
| 3,229,809 | 1/1966 | Spadaro | 206/0.82 |
| 3,241,659 | 3/1966 | Segel | 206/0.82 |
| 3,448,850 | 6/1969 | Segel et al. | 206/0.8 |
| 3,615,005 | 10/1971 | Segel et al. | 206/0.82 |
| 3,782,537 | 1/1974 | Segel | 206/0.82 |
| 3,788,464 | 1/1974 | Skinner | 206/0.82 |
| 4,165,573 | 8/1979 | Richards | 40/10 D |
| 4,320,831 | 3/1982 | Szabo et al. | 206/0.82 |
| 4,385,688 | 5/1983 | Grant | 206/0.82 |
| 4,592,465 | 6/1986 | Stein | 206/0.83 |
| 4,878,579 | 11/1989 | Hager | 206/0.84 |
| 4,915,214 | 4/1990 | Wieder | 206/0.82 |

FOREIGN PATENT DOCUMENTS

| | | | |
|---|---|---|---|
| 100911 | 2/1984 | European Pat. Off. | 206/0.83 |
| 1511150 | 5/1954 | Fed. Rep. of Germany . | |
| 2358857 | 2/1978 | France | 206/0.82 |

OTHER PUBLICATIONS

ANACS Cache advertised in *Coin World* on Wednesday, Feb. 8, 1989 at p. 29.

NGC Coin Holder, advertised in *Coin World* on Wednesday, Jan. 18, 1989.

*Primary Examiner*—William I. Price

*Attorney, Agent, or Firm*—Killworth, Gottman, Hagan & Schaeff

[57] ABSTRACT

An improved coin holder for the storage, display and protection of graded coins and other valuables is disclosed. Various tamper-resistant and tamper-evidencing features of the coin holder discourage and prevent fraudulent attempts to obtain access to replace graded coins with those of lesser quality, or tamper with coin grading certificates sealed with the coin in an inner element. Additional features discourage and make difficult the wholesale counterfeiting of the coin holder itself. The coin holder may be partially disassembled to obtain direct, unobstructed access to the coin contained therein, while maintaining the integrity of the grading certificate retained in the inner element along with the coin. The device introduces greater security and certainty into the process of marketing graded and increasingly valuable numismatic items. With minor modifications, the present invention may be used to secure grading small and medium-sized valuables for transport, grading and sale, such as diamonds, jewels, jewelry, stamps, and the like.

61 Claims, 5 Drawing Sheets

1
4
8
2
20
36
34
11
27
6
7
5
26
34'
12
13
28
21
29
2
19
17
33
33'
31
19
18
31
10
14
44
19
19
16
25
15

PROTECTIVE COIN HOLDER

BACKGROUND OF THE INVENTION

The present invention relates to a coin holder, and more particularly to a tamper-resistant, tamper-evident coin holder.

Coin holders are used by numismatists, collectors, investors and the like to protect, store, and display their coins. Typically, two-piece plastic holders snap together to hold a coin in a transparent, recessed center portion which is molded into the holder. The pieces may simply be snapped apart and the coin removed to permit direct, physical inspection.

The increasing value and desirability of coins as investments has engendered growing interest in not only preservation, but in the accurate grading of coins. Grading services have, accordingly, entered the marketplace with coin holders of various designs. These holders are designed to permanently retain coins, along with corresponding grading information for that coin, thus providing a means of assuring future owners that the coins in the holders are of the indicated grades.

Concerns have arisen with the possibilities for fraud through undetected access to such holders, which would allow the coins to be switched or the information contained in the grading certificates to be altered. Similarly, concerns exist with wholesale counterfeiting of such coin holders and grading certificates. Known coin holders used by grading services contain holograms of symbols or logos in an attempt to insure authenticity of the product. Such holders are made of hard plastic and have sealed edges for security. A functional disadvantage of such designs is that they do not allow direct viewing of the coin's surfaces, and scratches and defects in the transparent coin holder can often be misinterpreted as imperfections in the subject coin.

Because of the significant impact grading has upon the value of coins, and the possibilities for fraud, the need remains for improved, secure coin holders which, nonetheless, permit display and inspection of the coin. Further, a need exists for a secure coin holder which, nonetheless, allows direct and unobstructed viewing the surface of the coin.

SUMMARY OF THE INVENTION

The present invention meets those needs by providing a coin holder which both protects a coin from inadvertent damage and secures the coin along with its grading certificate from undetected tampering. The coin holder of the present invention is comprised of an outer cover and an inner element slidably inserted and secured into the outer cover. The inner element contains the coin and grading certificate. When the inner element is removed from the outer cover, the surface of the coin may be viewed and inspected in an unobstructed manner through apertures in the inner element.

When the inner element is inserted into the outer cover, the coin holder protects the coin surface from inadvertent damage. Thus, when the coin is secured in the coin holder, the obverse and reverse surfaces of the coin may be viewed through transparent portions of the cover. Information appearing on the grading certificate, whether on the top or bottom surfaces thereof or along its edges, may be viewed through transparent portions of the outer cover.

A variety of means are used to detect the disassembly of the coin holder to prevent the undetected substitution of inferior coins or alteration of grading certificates. Such means include using tamper-evident devices such as thin-film tapes or other optically variable coatings and devices which are disrupted or destroyed when surfaces in contact with either side of such tapes, optically variable coatings or devices are separated; mechanical package design that includes complex and detailed features difficult to counterfeit or reproduce; and grading certificate design. Thin-film tapes, or optically variable coatings or devices may be used at points where the outer cover engages the inner element upon initial insertion of the inner element. Such tapes, coatings or devices irreversibly disrupt, destroy, become unreadable or change color when the inner element is subsequently removed from the outer cover, thus permanently evidencing such removal In similar fashion, the thin-film tapes, optically variable coatings or devices may be used at points of contact between components which are joined to form the inner element. Again, such tamper-evident devices will irreversibly indicate separation of attached components, as might occur in an attempt to gain access to either the coin or grading certificate.

Mechanical package design is also used to protect against tampering with the coin or grading certificate, and to protect against counterfeiting the subject coin holder. First, joints between components forming the inner element are joined by ultrasonic bonding methods. Additionally, metal pins may be located in the inner element at the joints between its components to discourage access to the coin or grading certificate by hot-wire or other cutting methods. Pins of non-circular cross section and dimensioned so as to not penetrate the outer surfaces of the inner element are preferable to prevent their removal by drilling. To protect against counterfeiting the coin holders, the inner element may include an annular area around the viewing apertures where a frosted, etched or milled design of complex or detailed features may be located on the inner surface. Typically, these features are introduced into the coin holder during the injection molding of the specific plastic components, where the complex design features have been etched into the mold cavity for transfer to the plastic part. The inside edges of the coin apertures may also have a design placed upon them. Additionally, the components of the inner element may be molded or formed with complex joints to make unauthorized replication more difficult. Finally, to protect against tampering and counterfeiting, the inner element is designed so that disassembly of its components renders those components unusable. By selectively weakening specific areas of those components and joining them with ultrasonic bonds at points around the periphery of the coin aperture, separation results in fracture of the inner element components.

Grading certificates may be made of any sheet material upon which identifying indicia may be registered. Tampering or counterfeiting of grading certificates is resisted by placing adhesives on both sides of the certificate and assembling the inner element plastic and certificate materials in layered or "sandwich" style. The certificate is torn and destroyed when the inner element components are separated after initial assembly. Further, when paper sheet material is used, the use of bleeding inks or laser printing on either security paper or paper having dyed designs will discourage alteration since the certificate substrate will be irreversibly changed through such processes. The information placed on the grading certificates may also be obliterated upon separation of the inner element components by placing clear adhesives on the certificates at the points where information is printed thereon. Alternatively, the same result may be achieved by printing information on thin-film tapes, or optically variable coatings or devices which will be irreversibly and visually damaged when the inner element components are separated.

DETAILED DESCRIPTION OF THE PREFERRED EMBODIMENT

Figure 1:
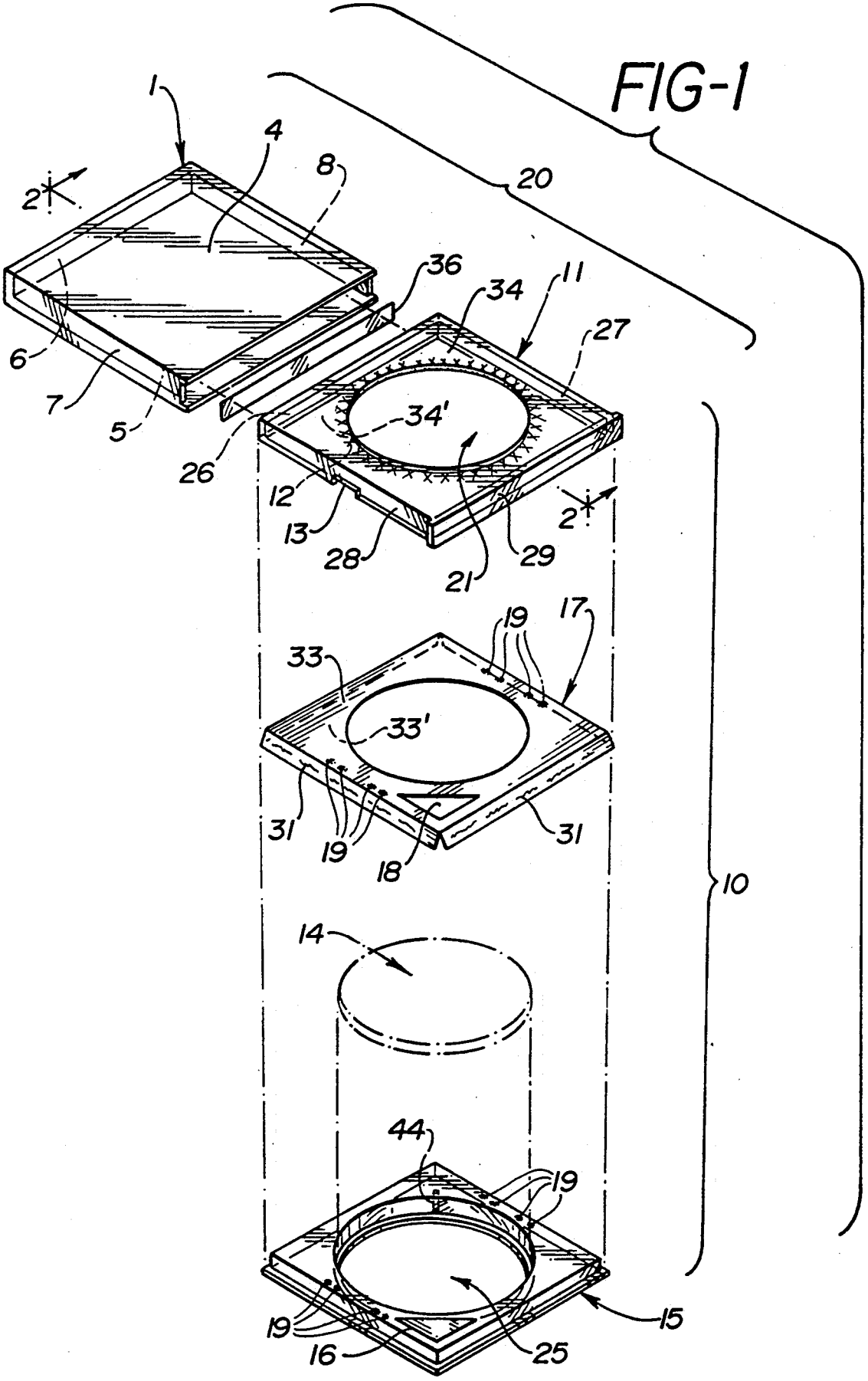
FIG. 1 is an exploded perspective view of the coin holder.
Figure 2:
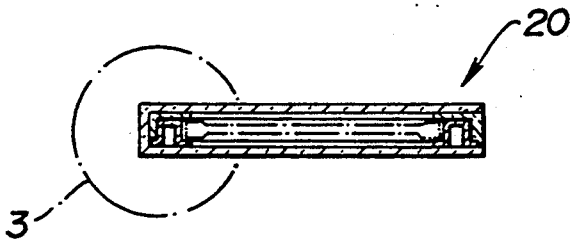
FIG. 2 is a cross section of the assembled coin holder of FIG. 1 at line 2—2.

Referring to FIG. 1, the coin holder 20 of the present invention is shown in an exploded view. All parts shown are preferably of commercially available plastic, such as Polycarb Makrolon 2500, except as noted below. In the preferred embodiment, the top 11 and bottom 15 components of the inner element 10 are assembled as shown and retain coin 14, shown in phantom for reference, and grading certificate 17 between them. (See also FIGS. 2 and 3). Adhesive 19, preferably transparent, is shown typically applied to secure grading certificate 17, preferably made of paper, to both the top and bottom components 11 and 15, causing the grading certificate 17 to be torn if top and bottom components 11 and 15 are separated after initial assembly. Particularly desirable is placement of adhesive 19 near locations where grading information appears on grading certificate 17. Grading certificate 17 may, alternatively, be made of any sheet material upon which identifying indicia may be registered. Also shown typically, aperture 18 in grading certificate 17 permits tamper-evident devices, such as thin-film tape 16, to adhere to both the top and bottom components 11 and 15. The thin-film tape 16 may also extend beyond aperture 18 to adhesively attach to a portion of grading certificate 17. This technique serves to cause the same tearing action upon separation of components 11 and 15 as noted above. Thin-film tape 16 is of the type which will either be distorted, destroyed, rendered unreadable or caused to change color when top and bottom components 11 and 15 are separated.

Figure 3:
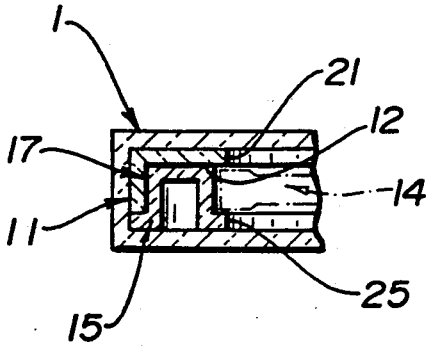
FIG. 3 is an enlarged detail of area 3 from FIG. 2.
Figure 4:
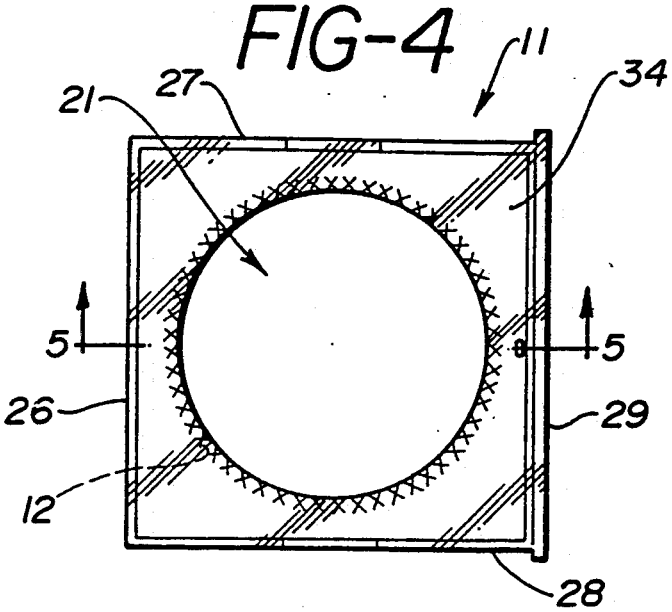
FIG. 4 is a top view of the top component of the inner element.
Figure 6:
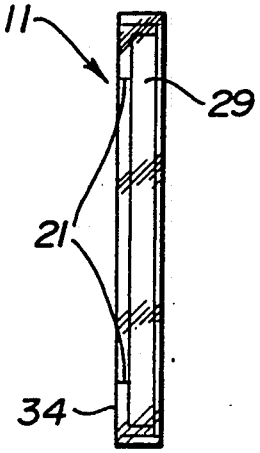
FIG. 6 is a side elevational view of the top component of the inner element of FIG. 5.
Figure 5:
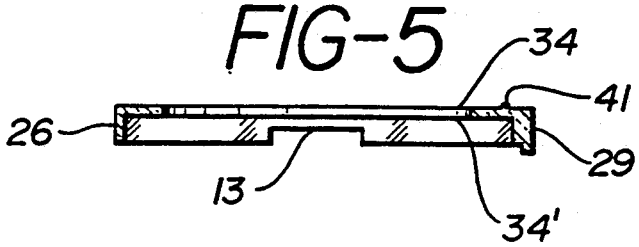
FIG. 5 is a cross-sectional view of the top component of the inner element of FIG. 4 at line 5—5.
Figure 7:
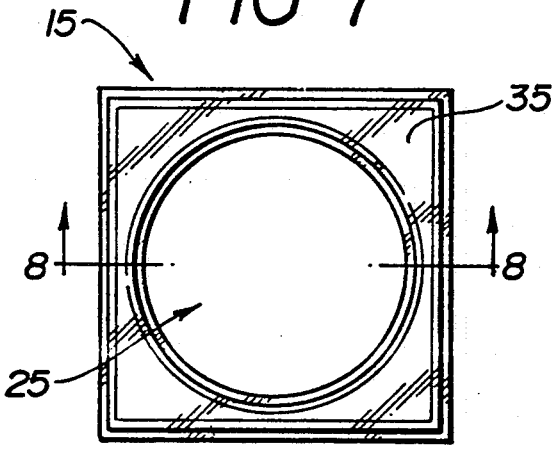
FIG. 7 is a top view of the bottom component of the inner element.
Figure 8:
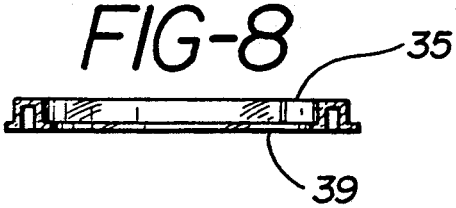
FIG. 8 is a cross-sectional view of the bottom component of the inner element of FIG. 7 at line 8—8.
Figure 9:
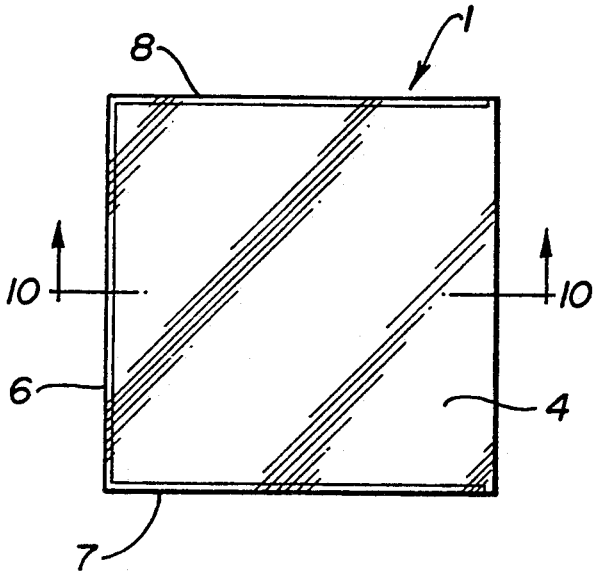
FIG. 9 is a top view of the outer cover.
Figure 11:
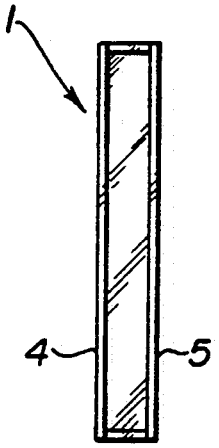
FIG. 11 is a side elevational view of the outer cover of FIG. 9.
Figure 10:
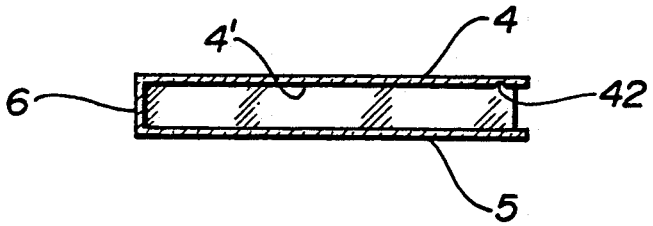
FIG. 10 is a cross-sectional view of the outer cover of FIG. 9 at line 10—10.

As shown in FIGS. 1, 3, and 4 an annular area 12, preferably on surface 34' around the circumference of aperture 21, is, preferably, a detailed and complex design, introduced into the plastic component during the injection molding process, to make counterfeiting of coin holder 20 difficult. Similarly, a detailed or complex design could be frosted, milled or etched on surface 34' or surface 34' (not shown), or on surfaces 35 and 39 (not shown) around aperture 25 of component 15. For similar reasons, the inner diameters of apertures 21 and 25 may be patterned (not shown). As well, although not preferred, top and bottom components 11 and 15 may be molded with complex joints to further discourage unauthorized replication. Finally, to protect against both tampering and counterfeiting, top and bottom components 11 and 15 may be selectively weakened (not shown) as, for example, by having thinned wall sections in specific areas, and may be sealed along the inner periphery of apertures 21 and 25 (shown typically at 32 in FIG. 3) to cause top and bottom components 11 and 15 to fracture when separated. Although not preferred because of added complexity, additional security features are possible, such as the use of pins 44 shown typically in FIG. 1 placed transversely or vertically across joints between the top and bottom components 11 and 15 of inner element 10. Preferably made of metal, such pins 44 discourage disassembly of inner element 10 by hot-wire or other cutting techniques, since such cutting techniques are ineffective on metal. Pins of non-circular cross-section, dimensioned so as to not penetrate the outer surfaces of the inner element, are further preferred to prevent removal by drilling.

Top component 11 and bottom component 15 Preferably injection molded as a single piece, may also be assembled from their respective constituent parts as shown respectively in FIGS. 4–6 and 7–8. Such constituent parts are joined, preferably, by ultrasonic bonding. When assembled to form inner element 10, top and bottom components 11 and 15 are also joined together, preferably, by ultrasonic bonding. Similarly, outer cover 1 is fabricated as a single unit, as shown in FIGS. 1 and 9–11, preferably by injection molding.

Inner element 10, once assembled, is slidably inserted into outer cover 1. A tamper-evident device 36, preferably a section of thin-film tape 36 including a double-side transparent adhesive layer, is placed between edge 6 of outer cover 1 and edge 26 of inner element 10, contacting both edges. Once outer cover 1 engages inner element 10, any separation of the two will cause thin-film tape 36 to distort, destruct, become unreadable or change color, permanently evidencing such separation. The inner element 10 may be retained in outer cover 1 by any number of methods, including a friction fit (not shown) and nub 41 and recess 42 (shown in FIGS. 5 and 10 respectively), or pin and hole combinations (not shown) between inner element 10 and outer cover 1. Friction fit may be enhanced by providing a slight taper to outer cover 1, narrowing from its mouth to its closed end. Preferred, is a raised nub 41 on surface 34 near edge 29, shown in FIG. 5, which nub 41 fits snugly in a corresponding recess 42 in surface 4' of outer cover 1, shown in FIG. 10. If removal of inner element 10 is desired to view a coin, a slight taper in the outer cover which can enhance retention by friction fit, serves to ease removal once the initial resistance to removal is overcome.

With reference to FIG. 1, when assembled, coin holder 20 permits viewing of both faces and, to a degree, the edges of coin 14. Coin holder 20 is preferably of standard size for numismatists, nominally two inches by two inches square. Information appearing on sides 31 of grading certificate 17, such as alphanumeric or bar code data, is visible through sides 6–8 and 26–29 of the outer cover and inner element respectively. Information (not shown) may also be printed on surfaces 33 and 33' of grading certificate 17 and viewed through transparent areas (not shown) in the outer cover and inner element. An alternative to using a paper grading certificate would be to register information such as that shown in FIG. 1 and described above on tamper-evident, thin-film tape or optically variable coatings which may be placed as desired between top and bottom components 11 and 15. However, paper grading certificates 17 are preferred, and may incorporate additional tamper-resistant qualities such as bleeding inks, laser printing, security paper, dyed patterned paper, water marks, low wet-strength, and propensities for irregular tearing.

Figure 12:
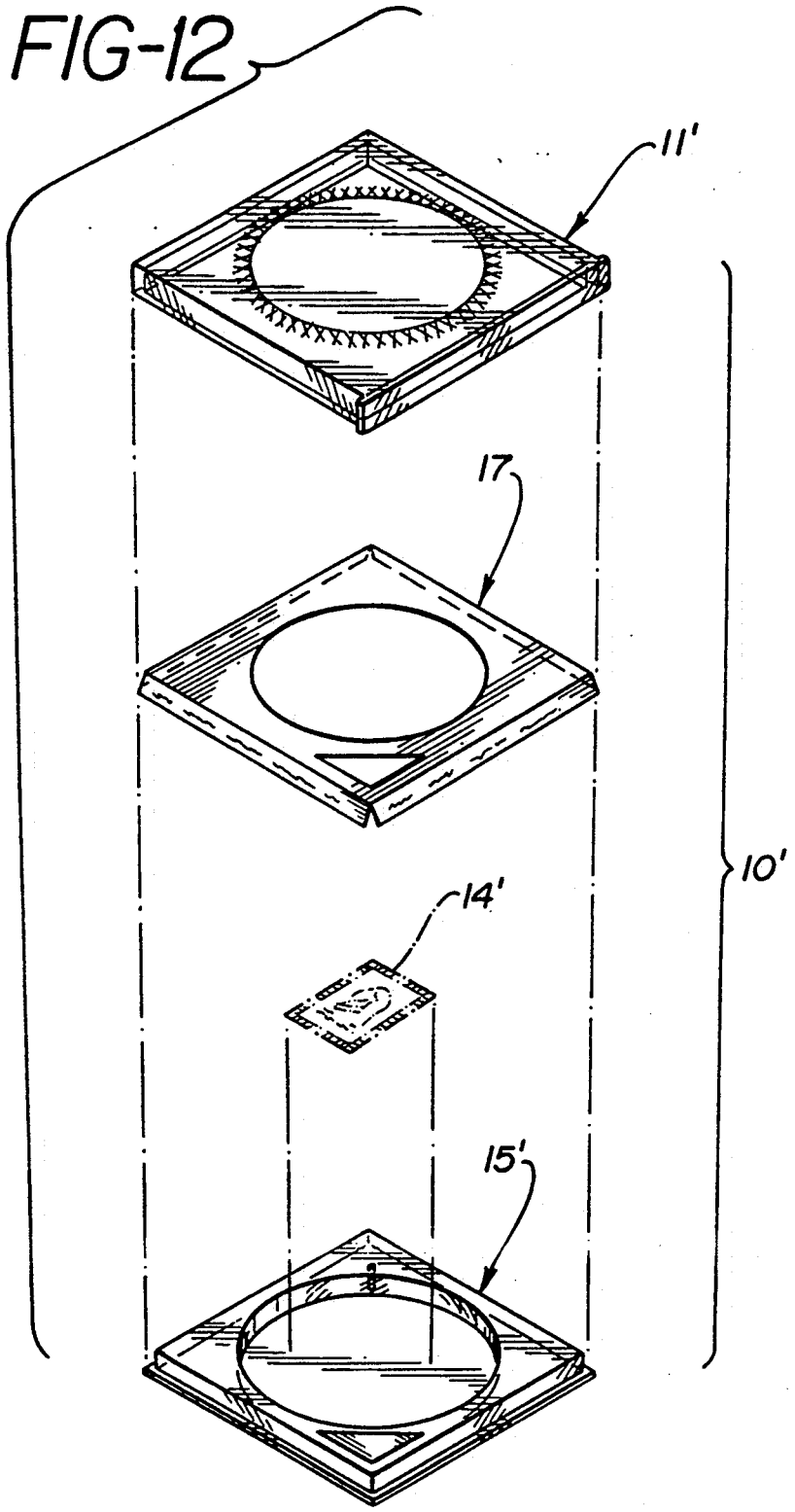
FIG. 12 is an exploded perspective view of the modified coin holder as a tamper-resistant, tamper-evident container for valuables or collectible items.

While certain representative embodiments and details have been shown and described for purposes of illustrating the invention, it will be apparent to those skilled in the art that various changes in the device disclosed herein may be made without departing from the scope of the invention which is defined in the appended claims. For example, aperture 21 in surface 34 (FIG. 5), and aperture 25 in surface 39 (FIG. 8) may be eliminated, thus completely enclosing the space between surface 39 and surface 34 to form container 10' as shown in FIG. 12. The cavity thus formed between container components 11' and 15' and the grading certificate 17 may then be used in connection with the analysis, transport, display and tamper-resistant storage of other small and moderately sized valuables or collectible items, such as diamonds, jewels, jewelry, stamps and the like.

What is claimed is:

1. A coin holder, comprising an outer cover;

an inner element adapted to retain a coin therein, slidably inserted into said outer cover;

means for removably securing said inner element in said outer cover; and tamper-evident means for permanently indicating removal of said inner element from said outer cover, said tamper-evident means interconnecting to at least a portion of opposing outer surfaces of said inner element and inner surfaces of said outer cover.

2. A coin holder as recited in claim 1 wherein said tamper-evident device means comprises thin-film tape.

3. A coin holder as recited in claim 1 wherein said tamper-evident means comprises an optically variable coating.

4. A coin holder as recited in claim 1 wherein said outer cover is made of transparent material.

5. A coin holder as recited in claim 1 wherein said outer cover includes one or more transparent portions.

6. A coin holder as recited in claim 1 wherein said outer cover is adapted to display identifying information.

7. A coin holder as recited in claim 1 wherein said outer cover is tapered to facilitate removal of said inner element.

8. A coin holder as recited in claim 1 wherein said inner element is made of transparent material.

9. A coin holder as recited in claim 1 wherein said inner element has one or more transparent portions.

10. A coin holder as recited in claim 9 wherein the surfaces of said inner element are adapted to display information thereon.

11. A coin holder, comprising an outer cover;

and inner element slidably inserted into said outer cover;

means for removably securing said inner element in said outer cover; and a tamper-evident device displaying information and disposed on at least a portion of one or more surfaces of said inner element.

12. A coin holder as recited in claim 11 wherein said tamper-evident device comprises thin-film tape.

13. A coin holder as recited in claim 11 wherein said tamper-evident device comprises an optically variable coating.

14. A coin holder as recited in claim 1 wherein said outer cover includes an aperture which slidably receives said inner element and top and bottom surfaces through which a coin in said inner element may be viewed; and said inner element has one or more apertures adapted to permit unobstructed viewing of a coin retained in said inner element when said inner element is removed from said outer cover.

15. A coin holder as recited in claim 14 wherein an annular area of design is defined around said one or more apertures.

16. A coin holder, comprising:

an outer cover;

an inner element comprised of two or more components, a sheet of material retained between said components, and means for joining said components, said inner element slidably inserted into said outer cover; and means for removably securing said inner element in said outer cover.

17. A coin holder as recited in claim 16 wherein said sheet of material has apertures to permit viewing a coin retained between said components.

18. A coin holder as recited in claim 16 wherein said inner element further comprises means for preventing the non-destructive removal of said sheet of material.

19. A coin holder as recited in claim 18 wherein said means for preventing a non-destructive removal of said sheet of material are one or more points for adhesives placed on said sheet of material.

20. A coin holder as recited in claim 16 wherein said sheet of material includes information displayed thereon.

21. A coin holder as recited in claim 20 wherein said sheet of material is paper.

22. A coin holder as recited in claim 20 further comprising means for preventing alteration of information displayed on said sheet of material.

23. A coin holder as recited in claim 22 wherein said sheet of material is paper adapted for displaying information and said means for preventing alteration of information on said paper comprises printing said information with bleeding ink.

24. A coin holder as recited in claim 22 wherein said sheet of material is paper adapted for displaying information and said means for preventing alteration of information on said paper comprises security patterns dyed in said piece of paper.

25. A coin holder as recited in claim 16 wherein one or more portions of said sheet of material are visible through said inner element.

26. A coin holder as recited in claim 16 wherein said components have complex interrelating joints.

27. A coin holder as recited in claim 16 wherein said means for joining comprises one or more ultrasonic bonds.

28. A coin holder, comprising an outer cover;

an inner element comprised of two or more components and means for joining said components;

said means for joining comprising one or more pins located transversely across joints between said components, said pins adapted to resist cutting; and said inner element slidably inserted into said outer cover; and means for removably securing said inner element in said outer cover.

29. A coin holder as recited in claim 28 wherein said pins have non-circular cross-section.

30. A coin holder, comprising an outer cover;

an inner element comprised of two or more components, means for joining said components and means for preventing non-destructive separation of said components, said inner element slidably inserted into said outer cover; and means for removably securing said inner element in said outer cover.

31. A coin holder as recited in claim 30 wherein means for preventing non-destructive separation of said components comprises one or more selectively weakened areas on said components, adapted to fracture said components upon separation of said components.

32. A coin holder as recited in claim 30 wherein said mean for preventing non-destructive separation comprises one or more seals between said components located and adapted to fracture said components upon separation of said components.

33. A coin holder, comprising an outer cover;

an inner element comprised of two or more components, means for joining said components, and means for permanently indicating the separation of said components, said inner element slidably inserted into said outer cover; and means for removably securing said inner element in said outer cover.

34. A coin holder as recited in claim 33 wherein said means for permanently indicating separation comprises a tamper-evident device communicating with at least two of said components.

35. A coin holder as recited in claim 34 wherein said tamper-evident device comprises thin-film tape.

36. A coin holder as recited in claim 34 wherein said tamper-evident device comprises an optically variable coating.

37. A coin holder as recited in claim 16 further comprising means for permanently indicating the separation of one or more of said components from said sheet of material.

38. A coin holder as recited in claim 16 wherein said sheet of material has one or more apertures through which said components may communicate.

39. A coin holder as recited in claim 38 further comprising means for permanently indicating the separation of two or more of said components.

40. A coin holder as recited in claim 39 wherein said means for permanently indicating separation is located at said apertures through which said components may communicate.

41. A coin holder, comprising an outer cover;

an inner element slidably inserted into said outer cover; and means for removably securing said inner element in said outer cover comprising one or more recesses in said outer cover and one or more nubs in said inner element insertable into corresponding ones of said recesses.

42. A coin holder as recited in claim 41 wherein said means for removable securing said inner element in said outer cover further comprises one or more frangible ultrasonic bonds.

43. A coin holder, comprising an outer cover;

an inner element comprised of two or more components, means for joining said component;

said inner element further comprising means to prevent counterfeiting said inner element; and said inner element slidably inserted into said outer cover; and means for removably securing said inner element in said outer cover.

44. A coin holder as recited in claim 43 wherein said means to prevent counterfeiting comprises one or more areas of design on one or more surfaces of said components.

45. A coin holder, comprising an outer cover;

an inner element including one or more apertures having designs on their inner diameters, said inner element slidably inserted into said outer cover; and means for removably securing said inner element in said outer cover.

46. A container adapted to display, house and protect a collectible item comprised of two or more container components;

means for joining said container components, such that a cavity is defined between said container components for housing said collectable item; and tamper-evident means for preventing undetected access to said cavity, said tamper-evident means disposed between said two or more container components and interconnecting at least a portion of opposing inner surfaces of at least two or more of said container components.

47. A container as recited in claim 46 further comprising a sheet of material retained between said container components, said sheet of material further comprising at least one aperture through which said tamper-evident means may interconnect said inner surfaces, said sheet of material adapted to include indicia relating to said collectible item.

48. A container as recited in claim 46 wherein said container components include one or more transparent portions.

49. A container as recited in claim 46 wherein said means for joining are ultrasonic bonds.

50. A container as recited in claim 46 wherein said means for preventing undetected access comprises means for permanently indicating the separation of said container components.

51. A container as recited in claim 46 wherein said tamper-evident means comprises thin-film tape.

52. A container as recited in claim 46 wherein said tamper-evident means comprises an optically variable coating.

53. A container as recited in claim 46 wherein said container components are substantially rigid; and said tamper-evident means for preventing undetected access comprises one or more selectively weakened regions on said container components, whereby said container components fracture upon separation thereof.

54. A container as recited in claim 53 wherein said tamper-evident means for preventing undetected access further comprises one or more bonds selectively joining regions of opposing surfaces of said container components, whereby said container components fracture upon separation of said container components.

55. A container adapted to display, house and protect a collectable item comprising two or more container components;

means for joining said container components, such that a cavity is defined between said container components for housing said collectable item;

a sheet of material retained between said container components;

adhesives at one or more points on said sheet of material attaching said sheet of material to one or more of said container components, whereby said sheet of material is destroyed upon separation of said container components.

56. A container as recited in claim 55 wherein said sheet of material comprises paper.

57. A container as recited in claim 55 further comprising information on said sheet of material and means for preventing alteration of information on said sheet of material.

58. A container as recited in claim 57 wherein said means for preventing alteration of information comprises security patterns dyed in said piece of paper.

59. A container as recited in claim 46 further wherein said means for joining comprises one or more pins located transversely across joints between said container components, said pins adapted to resist cutting.

60. A container adapted to display, house and protect a collectable item comprised of two or more container components;

means for joining said container components, such that a cavity is defined between said container components for housing said collectable item; and tamper-evident means for permanently indicating separation of said container components, said tamper-evident means comprising thin-film tape.

61. A container adapted to display, house and protect a collectable item comprised of two or more container components;

means for joining said container components, such that a cavity is defined between said container components for housing said collectable item; and tamper-evident means for permanently indicating separation of said container components, said tamper-evident means comprising an optically variable coating.

* * * * *